US005383445A

United States Patent [19]

Dixon

[11] Patent Number: 5,383,445

[45] Date of Patent: Jan. 24, 1995

[54] INDIRECT HEATER

[75] Inventor: James M. Dixon, Washington, Mich.

[73] Assignee: Tri-Mark Metal Corporation, Detroit, Mich.

[21] Appl. No.: 127,251

[22] Filed: Sep. 27, 1993

[51] Int. Cl.[6] ..... F24H 3/02

[52] U.S. Cl. ..... 126/110 R; 431/116; 110/336

[58] Field of Search ..... 126/110 R, 116 R; 431/116; 122/52

[56] References Cited

U.S. PATENT DOCUMENTS

| | | | |
|---|---|---|---|
| 2,479,940 | 8/1949 | Kuhner | 126/110 R |
| 3,068,854 | 12/1962 | Freeman | 126/110 R |
| 3,358,672 | 12/1967 | Dirk et al. | 126/110 R |

FOREIGN PATENT DOCUMENTS

| | | | |
|---|---|---|---|
| 1177306 | 9/1964 | Germany | 126/110 R |

*Primary Examiner*—Carroll B. Dority
*Attorney, Agent, or Firm*—Barnes, Kisselle, Raisch, Choate, Whittemore & Hulbert

[57] ABSTRACT

An indirect heater for heating air to be used for drying, curing or heating having an enclosure housing a circulation fan, filter bank, heat exchanger module and a burner. The heat exchanger has a bundle of tubes received between a pair of spaced apart headers. A cylindrical burner tube extends through one header and the tube bundle and opens into the other header. The burner flame and gaseous combustion products are discharged into a replaceable sacrificial sleeve that is telescopically received in the burner tube. A fan recirculates the heated gases through the interior of the sleeve, burner tube and the tubes of the bundle to increase heat transfer to the exterior air. The enclosure has a base, two pairs of opposed sidewalls and a top wall overlying the sidewalls. Each sidewall has an inner skin, a framework of trusses, an outer skin and insulation between the skins. The inner skin consists of airtightly joined skin panels supported by the frame and which have expansion gaps between adjoining skin panels to permit thermal expansion and contraction. The outer skin has interlocking panels held in place without contacting directly the frame or inner skin for minimizing heat transmission through each sidewall.

29 Claims, 5 Drawing Sheets

INDIRECT HEATER

FIELD OF THE INVENTION

This invention relates to an indirect heater for heating a stream of air flowing through the heater and more particularly to an improved heat exchanger module for more efficiently transferring heat to the air and a more efficient insulated heater enclosure wall construction for preventing heat loss from the air.

BACKGROUND OF THE INVENTION

Indirect fired heaters are generally used in applications where a clean particulate-free stream of heated air is required. Typical uses of these heaters include paint bake ovens, dry off ovens, and food processing ovens, as well as for curing wood, heat treating metals and general ventilation heating. These heaters consist of an enclosure having an inlet and an outlet, a heat exchanger within the enclosure for transferring thermal energy from gas within the heat exchanger to the air within the enclosure, a burner for heating the gas within the heat exchanger and a fan in the enclosure for moving air through the enclosure. In operation, the fan draws air into the enclosure through the inlet, propels the air through the heat exchanger where it is heated and exhausts the air out the outlet to be used.

In a typical indirect heater, an air-to-air shell and tube heat exchanger is used to transfer heat from a burner associated with the exchanger to the air flowing through the enclosure. The heat exchanger has a plurality of hollow tubes bundled together defining a plurality of gas passages within the exchanger that are spaced apart to allow air within the enclosure to flow around the outside of the tubes. In operation, hot gaseous combustion products from the burner make a single pass through the heat exchanger and are exhausted through a flue gas outlet. As the hot gaseous combustion products pass through the interior of the heat exchanger tubes, thermal energy is transferred to the air in the enclosure flowing through the heat exchanger around the exterior of the tubes.

Unfortunately, the single pass design of this heat exchanger construction results in a great deal of wasted heat being exhausted out the flue outlet, significantly lowering the operating life and efficiency of the heat exchanger. For example, normal flue discharge temperatures for an exchanger of this construction are extremely high, typically ranging between 1400°-1500° F., which increases the cost to operate the heater. The high temperature of the flue gases flowing through the heat exchanger tubes also causes increased corrosion within the tubes reducing the operating life of the heat exchanger. The extreme heat that the heat exchanger is subjected to during operation further magnifies the detrimental effect of thermal cycling upon the exchanger which can accelerate tube metal fatigue possibly leading to the premature failure of one or more heat exchanger tubes. As a result of the combined effects of increased corrosion and accelerated metal fatigue, heat exchanger failure approximately every 2 to 3 years is not uncommon, requiring expensive servicing and replacement of the heat exchanger.

The enclosure housing the heat exchanger is typically of airtight construction and insulated to reduce heat transmission through the walls of the enclosure. However, the inside and outside surfaces of the walls of the enclosure are both supported by a frame that acts as a heat conductive path through each wall of the enclosure. This heat loss can be quite substantial, lowering the overall operating efficiency of the heater while undesirably increasing the temperature of the outside surface of the enclosure walls. Should a nearby worker contact the outer enclosure surface, they could be severely burned or otherwise injured while distracted by the hot outer surface.

SUMMARY OF THE INVENTION

An indirect heater for heating an air stream for use in drying, curing or heating applications. The heater has an insulated enclosure that houses a circulation fan, a bank of filters and a heat exchanger module that includes a burner. In operation, the circulation fan moves air through the heat exchanger where it is heated, the filter bank where it is cleaned, and forces it out of the enclosure for use.

The heat exchanger has a bundle of spaced apart heat exchanger tubes received at each end in a header for recirculating a heated gaseous mixture of air and combustion products through the tubes to increase heat exchanger efficiency. For heating and recirculating the gaseous mixture, a burner tube extends through one header and the tube bundle and is received in the other header. Preferably, telescopically received within the burner tube is a generally cylindrical, replaceable, sacrificial burner sleeve that encompasses the burner outlet and burner flame for protecting the burner tube from the heat and direct flame radiation produced during combustion to increase the operating life of the heat exchanger module.

Both the burner tube and sleeve are in fluid flow communication with the headers to enable gas heated in the burner tube and sleeve to circulate through the heat exchanger tubes and transfer its heat to air within the enclosure flowing around the exterior of the tubes. Preferably, the sleeve is concentric with and has a smaller diameter than the burner tube for creating an annular fluid passageway between the burner tube and sleeve for allowing gas flowing through the passageway to be more uniformly heated by the sleeve while simultaneously cooling the sleeve to prolong the life of the sleeve.

The heat exchanger module has a pair of recirculation fans connected with one header for creating a forced draft within the module to recirculate gas through the burner tube and sleeve and the heat exchanger tubes to improve exchanger efficiency. To assist in recirculating the gas inside the heat exchanger, the opposite header preferably has a flow separator for splitting the flow of heated gas leaving the burner tube and sleeve, and canted end walls for directing each heated stream into the heat exchanger tubes. Preferably, the recirculation fans recirculate the gas within the heat exchanger module at a sufficiently high flow rate for inducing or enhancing turbulent flow within each heat exchanger tube to increase heat transfer to the air passing through the heater enclosure.

Preferably, each wall of the heater enclosure has an inner skin that is supported by a framework of trusses, an outer skin, and at least one layer of insulation between the inner and outer skin. Preferably, to reduce heat transfer and maintain the outer skin at a lower safe operating temperature, the outer skin is held in place adjacent the insulation without being secured to or contacting directly the trusses or inner skin. This wall construction minimizes the surface area and number of heat conductive paths through each wall of the enclosure. Preferably, there is a retainer sheet between the outer skin and the trusses and insulation to hold the insulation in place. Preferably, the panels of the outer skin are held in place adjacent the insulation retainer sheet by bands of flashing that run along the top and bottom of the enclosure.

To support the inner skin, the framework has a plurality of vertically spaced apart and horizontally extending trusses. Preferably, each truss includes inner and outer elongate angle iron stringers that are held apart by tubes spaced along the stringers for producing a lightweight, durable frame that has a minimum number of heat conductive pathways between the inner and outer stringers.

Objects, features and advantages of this invention are to provide an indirect heater which has improved efficiency, lower heat exchanger and burner tube operating temperatures to retard tube degradation and corrosion, a burner sleeve that is sacrificial and easily replaceable for shielding the burner tube from heat and burner flame radiation to prolong the life of the burner tube and heat exchanger; recirculates heated gas within the heat exchanger for improving efficiency, and inducing or enhancing turbulent flow within the heat exchanger tubes for improving heat transfer through the tubes while lowering their operating temperatures and prolonging heat exchanger operating life; an enclosure wall construction which minimizes heat transfer through the wall for increasing heater efficiency and reducing outer skin temperatures to lower the risk of injury; and both of which are rugged, durable, of simple design, of economical manufacture and easy to assemble and use.

BRIEF DESCRIPTION OF THE DRAWINGS

These and other objects, features and advantages of this invention will become apparent from the following detailed description, appended claims, and accompanying drawings in which:

DETAILED DESCRIPTION OF THE INVENTION

Figure 1:
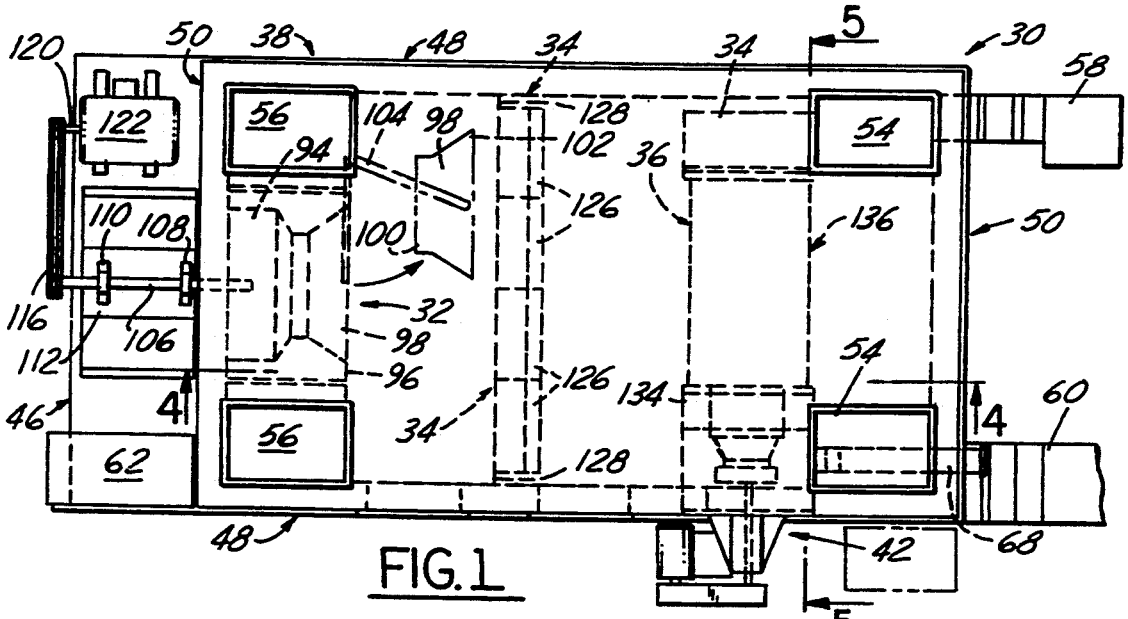
FIG. 1 is a plan view of an indirect heater of this invention illustrating a heater enclosure and, in phantom, the layout of a circulation fan, a filter bank, and a heat exchanger module of this invention housed within the enclosure.
Figure 2:
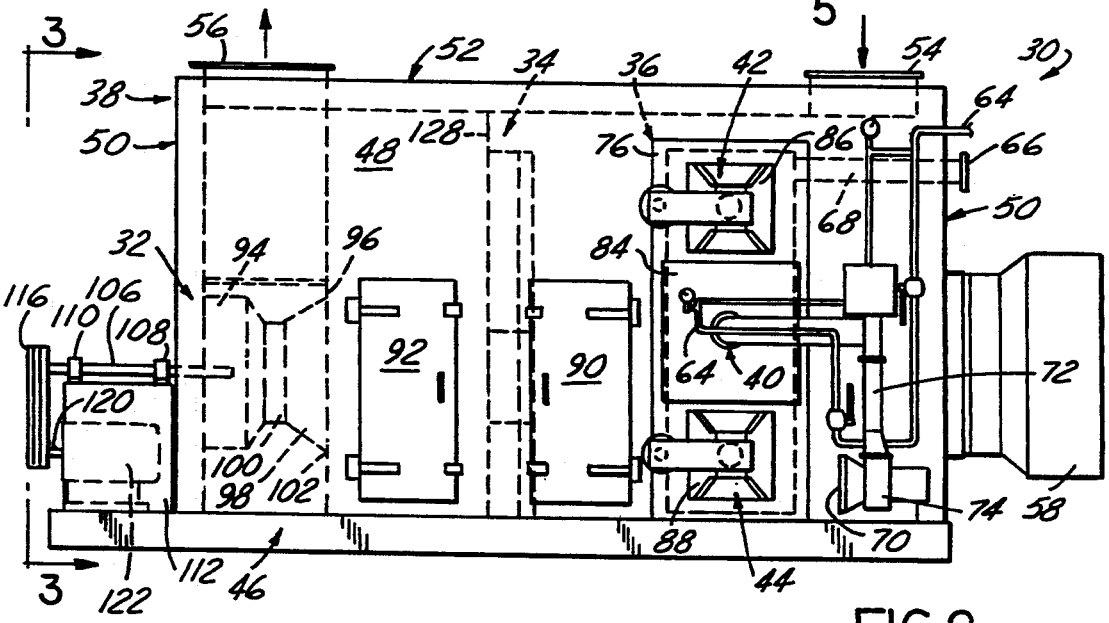
FIG. 2 is a side elevational view of the heater showing a pair recirculation fans and a burner operably associated with the heat exchanger module.

Referring in more detail to the drawings, FIGS. 1 & 2 illustrate an indirect heater 30 having a circulation fan 32, a bank of filters 34 and a heat exchanger and burner module 36 housed within an enclosure 38 for indirectly heating a stream of air to be used, for example, to bake paint, dry objects, process food, cure wood, heat treat metal, or heat a ventilated space. The heat exchanger module 36 includes a burner 40 to heat a mixture of air and gaseous combustion products within the module 36 to transfer heat to air passing through the enclosure 38. The heat exchanger 36 also has a pair of vertically spaced apart recirculation fans 42, 44 for recirculating the gas within the module 36 to increase heat exchanger efficiency. During operation, the circulation fan 32 moves air within the enclosure 38 through the heat exchanger 36 where it is heated, draws the hot air through the filter bank 34 where it is filtered, and expels the air from the heater 30 where it is used for drying, curing or heating.

The enclosure 38 is of generally rectangular cross section having a base wall 46 (FIG. 2), a pair of opposed sidewalls 48 and a pair of opposed end walls 50 extending upwardly from the base 46, and a top wall 52 overlying walls 48, 50. To permit the circulation fan 32 to bring air to be heated into the enclosure 38, the top wall 52 has a pair of inlets or return taps 54 that are connected to ductwork (not shown). The top wall 52 also has a pair of outlets or supply taps 56 generally overlying the circulation fan 32 which are connected to ductwork (not shown) for exhausting the air from the enclosure 38 after it has been heated and filtered.

Figure 4:
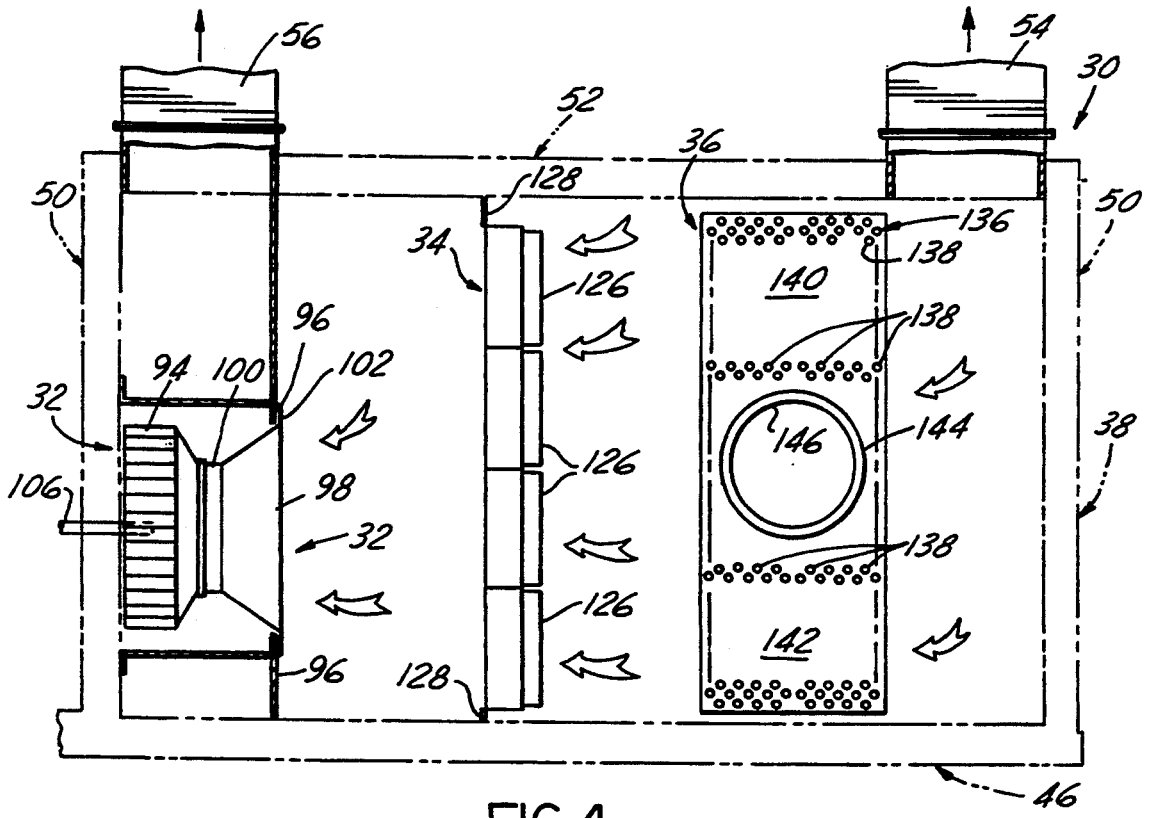
FIG. 4 is a sectional view of the heater enclosure taken along line 4—4 of FIG. 1 more clearly showing the circulation fan and filter bank, while illustrating a transverse cross sectional view of the heat exchanger module.

As is indicated by the arrows shown in FIG. 4, air entering the enclosure 38 through the return taps 54 passes through the heat exchanger module 36 and the filter bank 34 before being propelled by the circulation fan 32 from the enclosure 38 out the supply taps 56. If desired, such as to dilute volatiles in the circulating air, fresh air can be added to the circulating air through a damper-controlled makeup air inlet 58 adjacent return tap 54 at one end of the enclosure 38.

Operation of the heater 30 is governed by a pair of control panels 60, 62, one at each end of the enclosure 38. During operation, fuel, such as natural gas, is fed to the burner 40 through a train of piping 64 where it is ignited to heat the gas circulating within the heat exchanger module 36. Extending outwardly from end wall 50 and adjacent the gas train piping 64 is a flue gas tap 66 connected by a preferably damper-controlled duct 68 (in phantom) to the heat exchanger 36 for removing a portion of the byproducts of burner combustion from the heat exchanger 36. Adjacent the piping 64 is a burner makeup air tap 70 connected by a duct 72 to the burner 40 for introducing oxygen-containing fresh air, as necessary, into the module 36 to maintain an optimum fuel-air ratio to support efficient combustion within the heat exchanger 36. Preferably, the makeup air duct 72 has a blower 74 associated with it to controllably inject outside air into the heat exchanger module 36 as additional oxygen for combustion is needed.

The entire heat exchanger module 36 preferably rests upon rails (not shown) within the enclosure 38 and is mounted to a generally rectangular access door 76 attached to the enclosure 38 which can be removed to slide the heat exchanger module 36 free of the enclosure 38 to service or replace the module 36. As is shown more clearly in FIGS. 6 & 7, the door 76 is mounted to enclosure sidewall 48 by a series of bolts 78 that project through the door 76 and a U-channel frame 80 fixed to the sidewall 48. To permit the door 76 to be removed to withdraw the heat exchanger 36 from the enclosure 38, each bolt 78 is secured by a nut 82 threadably received on the threaded end of bolt 78.

The burner 40 is mounted to a plug-type access door 84 secured to the heat exchanger module access door 76 which can be removed to inspect, maintain or replace the burner 40 or other parts of the heat exchanger module 36. Similarly, a pair of vertically spaced apart access plugs 86, 88 is removably secured to the door 76 to permit maintenance to be performed on either or both recirculation fans 42, 44.

To inspect or maintain the filter bank 34 or the heat exchanger module 36, the enclosure 38 has a hinged access door 90 that lies between the filter bank 34 and heat exchanger module 36. Preferably, the enclosure 38 has an access door (not shown) in end wall 50 to provide inspection and maintenance access to the opposite side of the heat exchanger module 36. For inspecting, cleaning or replacing the circulation fan 32, the enclosure 38 has another hinged access door 92 that lies between the fan 32 and the filter bank 34.

Figure 3:
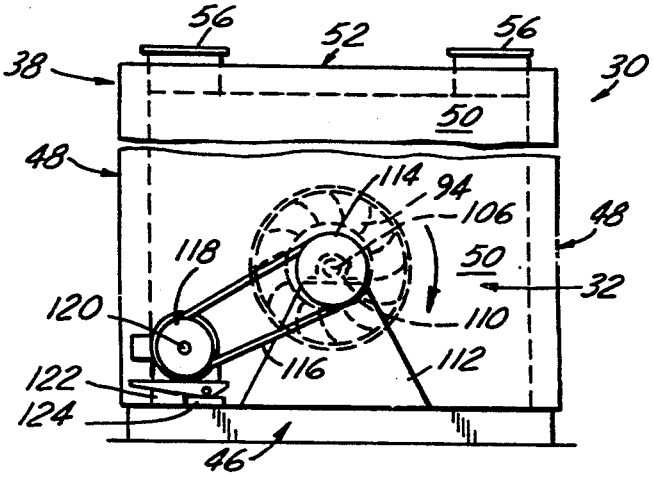
FIG. 3 is an end elevational view of the heater as viewed along line 3—3 of FIG. 2.

Referring additionally to FIGS. 3 & 4, the circulation fan 32 has an impeller 94 beside an airtight partition 96 within the enclosure 38. To direct air into the impeller 94 during operation of the circulation fan 32, the fan 32 has an inlet cone 98 that has a necked down portion 100 at one end which is in communication with the fan impeller 94 and a circumferentially-continuous outwardly flared flange 102 at its opposite end which provides a seal with the partition 96. As is shown in phantom in FIG. 1, the fan inlet cone 98 is pivotally mounted to a swing arm bracket 104 for moving the cone 98 away from the impeller 94 to inspect, clean, repair or replace the impeller 94.

The impeller 94 is attached to one end of a shaft 106 rotatively supported by a pair of spaced apart bearings 108, 110 mounted on a pedestal 112 that rests upon base wall 46. A sheave 114 at the opposite end of the shaft 106 is connected by a belt 116 to a second sheave 118 mounted on an output shaft 120 of an electric motor 122. Preferably, both sheaves 114, 118 and the belt 116 are covered by a protective guard (not shown) to prevent injury during operation of the circulation fan 32. The electric motor 122 is secured to base 46 by a pivotable mount 124 for enabling quick and easy removal and installation of belt 116. When energized, the motor 122 turns the impeller 94 in a clockwise direction, as is indicated by the arrow in FIG. 3, to circulate air through the enclosure 38.

Preferably, the impeller 94 of the circulation fan 32 is a size 4025 impeller manufactured by Northern Blower or equivalent able to move up to 24,000 cubic feet per minute of air through the enclosure 38 while rotating at approximately 1185 revolutions per minute and is driven by a commercially available electric motor 122 capable of providing up to forty horsepower for rotating the impeller 94 at the desired speed. Depending upon the air flow volume and heat load required for various applications of the heater 30, the impeller 94 and circulation fan motor 122 can be sized accordingly to provide more or less air flow through the enclosure 38 and taps 54, 56.

As is illustrated in FIG. 4, air drawn into the heater enclosure 38 by the circulation fan 32 passes through the filter bank 34 before being propelled by the fan 32 through the supply taps 56 and out of the enclosure 38. The filter bank 34 has a plurality of individual filters 126 that are mounted in a partition 128 within the enclosure 38. As is more clearly depicted in FIGS. 1 & 4, preferably the individual filters 126 are stacked four high and four wide and held in place by the filter bank partition 128. As air moves through the enclosure 38 during heater operation, the partition 128 blocks air flow around the filters 126 thereby directing it through the filters 126 for providing a stream of clean air that can be used in applications, such as paint baking, that require particulate free air for drying.

Figure 5:
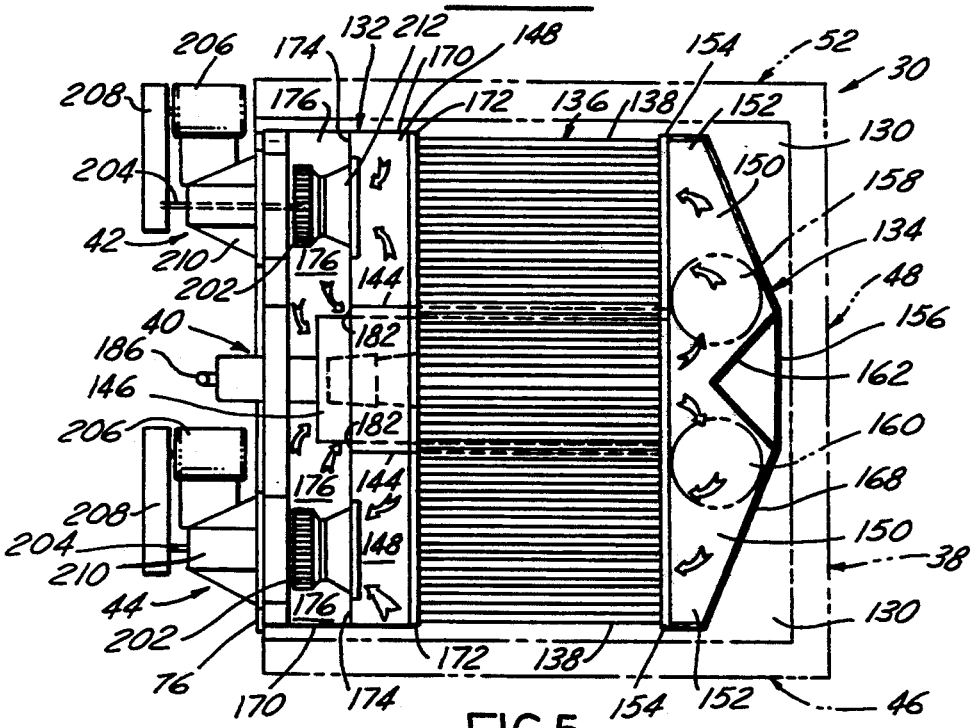
FIG. 5 is a sectional view of the heater enclosure taken along line 5—5 of FIG. 1 depicting the recirculation fans, burner and a longitudinal cross sectional view of the heat exchanger.

Referring more particularly to FIGS. 4 & 5, before reaching the filter bank 34, air entering the enclosure 38 through the return taps 54 must pass through the heat exchanger module 36 where heat is transferred to the air from hot gas within the module 36 heated by the burner 40. To direct air entering the enclosure 38 through the module 36 so it can be heated, the module 36 is airtightly framed in a partition 130 within the enclosure 38 that extends outwardly to seal against the inner surfaces of the enclosure base 46, sidewalls 48 and top wall 52.

Heat Exchanger Module

The heat exchanger module 36 has a pair of vertically upright headers 132, 134 that are spaced apart by and sealed in fluid flow communication with a horizontally extending tube bundle 136. The tube bundle 136 is constructed of a plurality of hollow tubes 138 to permit heated gas, typically a mixture of air and burner combustion gases, to circulate within the headers 132, 134 and the interior of the heat exchanger tubes 138 (tube side) to transfer heat to air in the enclosure 38 simultaneously passing through the tube bundle 136 and around the exterior of the tubes 138 (shell side). Within the tube bundle 136 and dividing the bundle into an upper 140 and a lower 142 cluster of heat exchanger tubes 138 (FIG. 4), is a burner tube 144 in fluid flow communication with header 134 and a burner sleeve 146 generally telescopically received in the burner tube 144 for encompassing the burner 40 and shielding the burner tube 144 from the direct flame (not shown) of the burner 40. The recirculation fans 42, 44 are positioned within the forward header 132 for redirecting most of the still relatively hot gas exiting the tube bundle 136 back into the burner tube 144 and sleeve 146, instead of being expelled out the flue gas tap 66, to increase the efficiency of the heat exchanger module 36.

Headers

The headers 132, 134 provide a gas tight chamber 148, 150 (FIGS. 5 & 6) at each end of the tube bundle 136 to facilitate circulation within the heat exchanger module 36. Preferably, both headers 132, 134 are constructed of a durable and long-lasting stainless steel, such as 304 stainless, possessing high corrosion and heat resistant properties necessary for use in the demanding environment of the heat exchanger 36 and heater 30.

As is illustrated in FIG. 5, the rear header 134 has a pair of sidewalls 152 that extend from an end plate 154 secured to one end of the tube bundle 136 to an end wall 156 of the header 134. To permit maintenance access within the rear header 134, the sidewall 152 has a pair of vertically spaced apart and generally circular access plugs 158, 160. Preferably, within the rear header chamber 150 is a generally V-shaped flow separator 162 that extends inwardly from the header end wall 156 and generally coaxially overlies both the burner tube 144 and sleeve 146 for splitting the heated gas exiting the burner tube 144 and sleeve 146 into two streams, indicated by the arrows shown in FIG. 5, so that the hot gas is directed into both the upper and lower tube clusters 140, 142. Preferably, the end wall 156 has a pair of inwardly canted panels 166, 168 to assist in guiding each stream of heated gas into the upper and lower tube clusters 140, 142. Preferably, each canted panel 166, 168 has a removable access door (not shown) for inspecting, cleaning and otherwise maintaining each cluster 140, 142 of the tube bundle 136.

The forward header 132 has a pair of sidewalls 170 of generally rectangular cross section that extend from an end plate 172 at the opposite end of the tube bundle 136 to a baffle plate 174 defining the end wall of the header 132. Sidewall 170 further extends beyond the header 132 and baffle plate 174 to the inner surface of the heat exchanger module access door 76 (FIG. 6) defining a chamber 176 therebetween. The baffle 174 has an opening 178 in sealed communication with the burner tube 144 (FIG. 7) and an opening 180 overlying each recirculation fan 42, 44 (FIG. 6) for conducting gas exiting the tube bundle 136 into the fans 42, 44 so the gas can be propelled back through the burner tube 144 and sleeve 146 to facilitate recirculation within the heat exchanger 36. As is shown in phantom in FIGS. 1 & 2, the flue gas duct 68 projects outwardly from header sidewall 170 to the flue gas tap 66 to provide a gas passageway adjacent the upper recirculation fan 42 that extends from forward chamber 176 to the exterior of the enclosure 38 for purging burner combustion gases from the heat exchanger module 36.

Tube Bundle

Capped at each end by the headers 132, 134, the tube bundle 136 consists of a plurality of generally cylindrical heat exchanger tubes 138 that open at one end into chamber 148 of the forward header 132 and at the opposite end into the chamber 150 of the rear header 134 for facilitating heat transfer from gas within each tube 138 to the air flowing through the enclosure 38. The tubes 138 are airtightly secured at each end to the end plates 154, 172 in a spaced apart preferably staggered array for providing airflow paths through the tube bundle 136 on the shell side of the heat exchanger 36 to allow the heater air to be heated as it flows across the exterior of the tubes 138 generally perpendicular to the axis of each tube 138 in a cross flow arrangement.

Preferably, each heat exchanger tube 138 is equipped with a turbulator (not shown) or a spiral baffle (not shown) extending longitudinally within each tube 138 for inducing turbulence in the gas flowing within each tube 138 to increase heat transfer through the sidewall of each tube 138 to the heater air. Preferably, the tubes 138 are constructed of 304 stainless steel or another corrosion and heat resistant stainless steel having high thermal conductivity for producing a thermally efficient and long-lasting tube bundle 136.

Preferably, the tube bundle 136 is constructed for use in an air-to-air cross flow type heat exchanger module 36 having the heat exchanger tubes 138 arranged in a staggered array. However, if desired, the tubes 138 may be secured to the end plates 154, 172 in a spaced apart aligned array. If desired, the number of tubes, tube diameter, and length and width of the tube bundle 136 can be varied according to the dimensions of the heater enclosure 38 and the heat load transfer characteristics required of the heater 30.

Burner Tube

Figure 7:
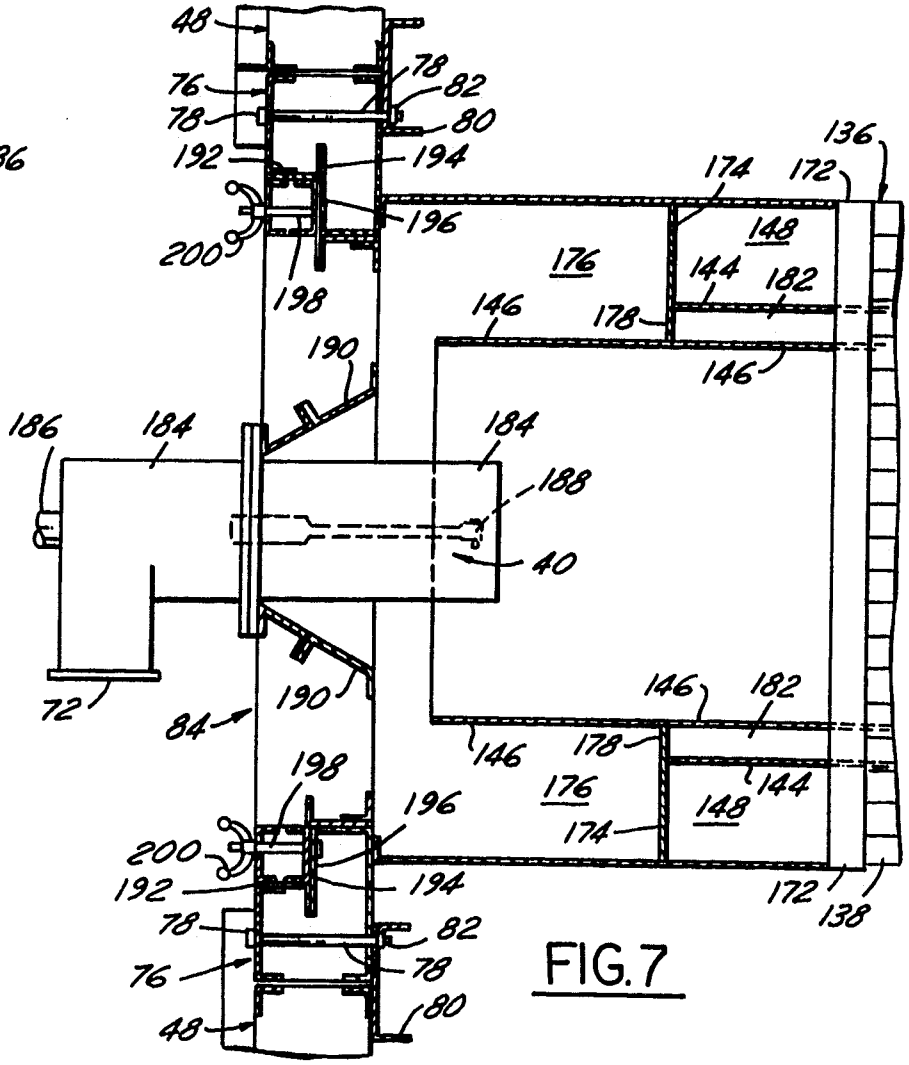
FIG. 7 is a fragmentary sectional view of the heater enclosure illustrating the burner mounted to an access plug door removably secured to the enclosure for enabling the burner to be readily removed for inspection, maintenance or replacement.

As is shown more clearly in FIG. 4, the burner tube 144 is preferably of generally cylindrical construction and lies in parallel with the heat exchanger tubes 138 of the tube bundle 136. The burner tube 144 is sufficiently large in diameter for receiving the burner sleeve 146 and burner 40 nested within the sleeve 146 (FIGS. 5 & 7). As is indicated in phantom in FIG. 5, the burner tube 144 is airtightly secured adjacent both ends to the end plates 154, 172 for creating a gas passageway between the rear header chamber 150 and chamber 176 adjacent the forward header 132. One end of the burner tube 144 extends through baffle plate opening 178 exteriorly of the forward header chamber 148 and opens into chamber 176 (FIG. 7) for admitting gas after it has passed through the heat exchanger tubes 138 back into the burner tube 144 and sleeve 146 to be reheated by the burner 40. The opposite end of the burner tube 144 is sealingly secured to end plate 154 and opens into the rear header chamber 150 for enabling the gas, after it has been heated, to flow into the chamber 150 and be directed into the heat exchanger tubes 138.

Preferably, the burner tube 144 is spaced from the heat exchanger tubes 138 of the tube bundle 136 to enable the air in the heater enclosure 38 to flow across the exterior surface of the burner tube 144 on the shell side of the heat exchanger 36 during heater operation for transferring heat from the burner tube 144 to the heater air. Preferably, the burner tube 144 is also constructed of 304 stainless steel or another corrosion and heat resistant thermally conductive stainless steel for producing a long-lasting burner tube 144 that can efficiently transfer heat from the burner 40, burner sleeve 146 and heated gas flowing through the burner tube 144 to the heater air flowing through the enclosure 38.

Burner Sleeve

The burner sleeve 146 is a generally cylindrical tube that is telescopically received in the burner tube 144 and encompasses the burner 40 for sacrificially shielding the burner tube 144 from the extreme heat and direct flame radiation of the burner 40 to significantly prolong the life of the burner tube 144. As is shown in FIG. 5, the sleeve 146 preferably extends from the base of the burner 40 substantially the length of the burner tube 144 (shown in phantom) for completely shielding the burner tube 144 from the burner flame during operation of the burner 40. Preferably, the burner sleeve 146 is removably secured within the burner tube 144 for easy replacement by simply removing the burner plug assembly 84 and withdrawing the sleeve 146 from the tube 144.

As is illustrated in FIGS. 4 & 7, the burner sleeve 146 is smaller in diameter than the burner tube 144 for providing a generally annular channel 182 between the burner sleeve 146 and tube 144 for allowing the sleeve 146 to thermally expand within the burner tube 144 and permitting gas to flow through the channel 182 to be heated by the sleeve 146 thereby cooling the sleeve 146 and prolonging its life. Preferably, the sleeve 146 is concentrically nested within the burner tube 144 for more uniformly radiating heat from the sleeve 146 to the tube 144 during operation of the burner 40 to increase heat transfer to the heater air flowing across the outer surface of the burner tube 144. If desired, the outer surface of the burner sleeve 146 can be covered with a highly emissive coating to further increase radiant heat transfer between the sleeve 146 and burner tube 144. To produce a sleeve 146 that is longlasting and of relatively economical construction, the burner sleeve 146 is preferably constructed of RA 330 stainless steel or another material possessing excellent high temperature, flame radiation and corrosion resistance.

Burner

Referring to FIGS. 5 & 7, the base of the burner 40 is enclosed by an inlet shroud 184 of the burner makeup air duct 72 that extends into chamber 176 and projects into the burner sleeve 146 so that the makeup air blower 74 can inject fresh outside air directly into and around the flame of the burner 40 during operation. Attached to one end of the burner 40 is a coupling 186 of the gas train 64 for transferring natural gas fuel to the burner 40 to be ignited during operation. The burner 40 has a nozzle 188 (shown in phantom in FIG. 7) at the other end for projecting the burner flame into the burner sleeve 146 to heat the air and combustion byproducts flowing through the sleeve 146. Preferably, the burner 40 is an Eclipse 200 RM Ratiomatic TM burner capable of generating up to 2,000,000 Btu/Hr manufactured by Exothermics-Eclipse, Inc. of Toledo, Ohio. Furthermore, it will be understood by one skilled in the art that the burner 40 can be sized according to the heat load demanded by the particular application of the heater 30.

To provide maintenance access to the burner 40 or to inspect and replace the burner sleeve 146, the burner 40 and makeup air inlet shroud 184 are secured to a rigid conically shaped mount 190 attached to the burner access plug 84, as is shown in FIG. 7. To provide a generally flush fit between the outer surfaces of the burner plug 84 and heat exchanger module access door 76, the plug 84 has an outwardly extending channel 192 of generally rectangular cross section about the periphery of the plug 84 that is received in a complementary recess 194 in the door 76. Attached to the door 76 within the recess 194 is an anchor plate 196 with a plurality of studs 198 that project outwardly through corresponding openings in the channel 192 of the burner plug 84. To secure the burner plug 84 to door 76, a wing nut 200 is threaded onto each stud 198 and tightened until the channel 192 bears firmly against the anchor plate 196. Preferably, a gasket (not shown) is sandwiched between the burner plug 84 and door 76 to provide an airtight seal between the plug 84 and access door 76 to prevent convective heat loss during operation. Preferably, the plug 84 is insulated to prevent heat loss through the plug 84.

Recirculation Fans

The recirculation fans 42, 44 are positioned within chamber 176 adjacent the forward header 132 to redirect the relatively hot gas exiting the heat exchanger tubes 138 back into the burner tube 144 and sleeve 146 to be reheated by the burner 40. The fans 42, 44 also preferably circulate the hot gas at a relatively high flow rate for inducing or further enhancing turbulent flow within the burner tube 144 and heat exchanger tubes 138 for increasing heat transfer to the heater air, thereby lowering the operating temperatures of the burner tube 144 and heat exchanger tubes 138 for significantly increasing the life of the heat exchanger module 36. During recirculation fan operation, when the damper of the flue gas tap 66 is opened, the upper recirculation fan 42 also provides sufficient pressure within chamber 176 to purge combustion gases from the heat exchanger 36 to maintain efficient burner 40 operation. Since the construction of recirculation fan 42 is essentially the same as fan 44, only fan 42 will be described in further detail.

Figure 6:
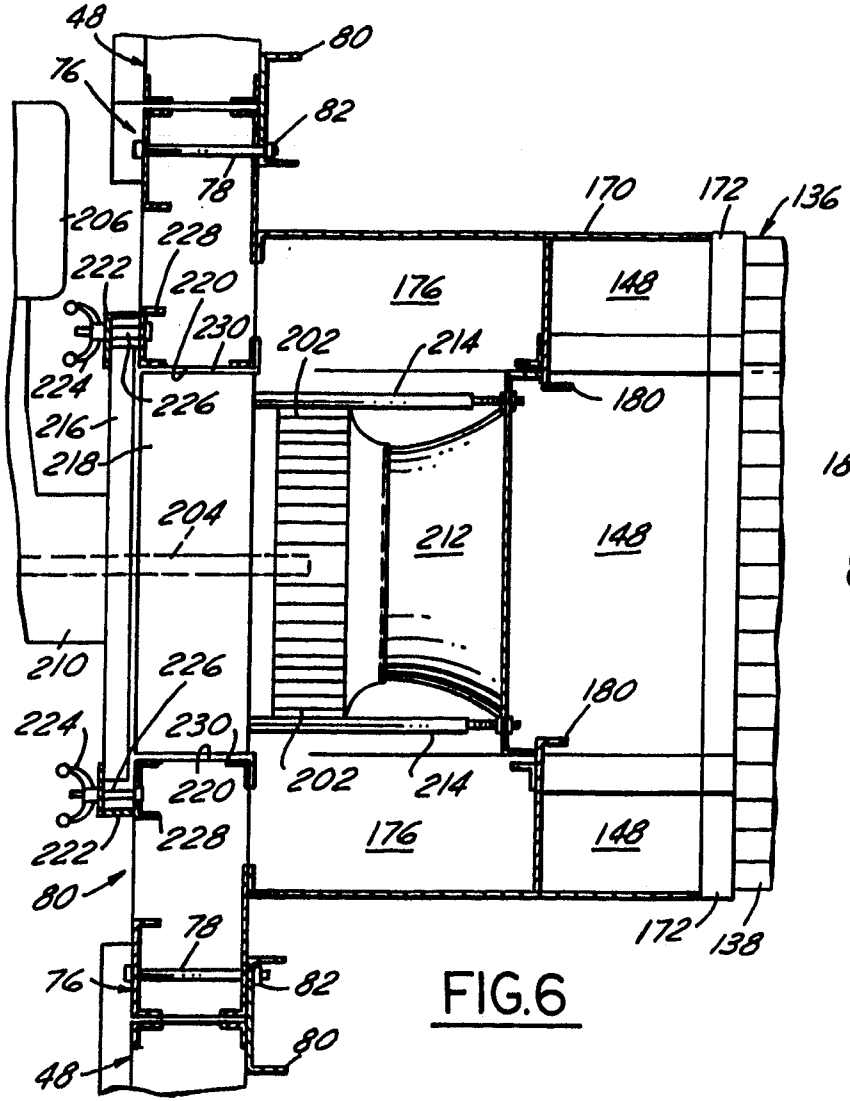
FIG. 6 is a fragmentary sectional view of the heater enclosure illustrating an access plug-type door removably secured to the enclosure for enabling each recirculation fan impeller to be readily removed for inspection, maintenance or replacement.

As is shown in more detail in FIG. 6, recirculation fan 42 has an impeller 202 that is completely received in chamber 176 and coaxially overlies baffle opening 180 for directing gas expelled from the tube bundle 136 into the forward header chamber 148 back into the burner tube 144 and sleeve 146 to be reheated. The impeller 202 is attached to one end of a shaft 204 that is connected by a belt (not shown) to an electric motor 206. Preferably, a protective guard 208 covers the belt to prevent injury during operation of the fan 42. To provide rotative bearing support, the shaft 204 passes through an outwardly extending stand 210 that is mounted to fan plug 86. As is more clearly depicted in FIG. 6, the fan 42 has an inlet cone 212 that is generally coaxially aligned with the impeller 202 and baffle opening 180 to direct gas leaving the heat exchanger tubes 138 into the impeller 202 to be recirculated. To properly space the fan inlet cone 212 from the impeller 202 and permit cone removal for cleaning and maintenance, the cone 212 is preferably removably mounted to the fan access plug 86 by at least two standards 214.

Preferably, the size of the impeller 202 and motor 206 of each recirculation fan 42, 44 is chosen to recirculate the heated gas within the heat exchanger module 36 at a high enough flow rate to dilute heat stratification within the module 36 while inducing or further increasing turbulence in the gas flowing within the burner tube 144 and heat exchanger tubes 138 for improving heat transfer to the air passing through the enclosure 38 and lowering the temperature and extending the life of the tubes 144, 138. Preferably, both of the recirculation fans 42, 44 have a size 1650 impeller manufactured by Northern Blower or equivalent able to move up to 4,500 cubic feet per minute of air through the heat exchanger 36 when driven by a commercially available 7½ horsepower electric motor 206 capable of rotating the impeller 202 at the desired speed. Depending upon the heat load demanded and burner heat generated for various applications of the heater 30, each impeller 202 and motor 206 can be appropriately sized or the speed of each impeller 202 varied to provide a greater or lesser flow rate through the module 36.

To provide maintenance access to the upper recirculation fan 42, the shaft bearing stand 210 is secured to fan access plug 86 which is removably mounted to the heat exchanger module access door 76, as is shown in FIG. 6. The fan access plug 86 has an outer cover 216 affixed to an inner plug body 218 which is sealingly received in an opening 220 in access door 76. To retain the plug 86 in the opening 220, the cover 216 is captured between an angle iron bracket 222 framing the cover 216 and the door 76. The fan access plug 86 is tightly secured against the door 76 by tightening a plurality of wing nuts 224 threadably received on threaded studs 226 that project outwardly from an anchor plate 228 embedded in the door 76 and are received in corresponding openings in bracket 222. Preferably, the outer cover 216 of the plug 86 is larger than the diameter of plug opening 220 so that the tightening of the wing nuts 224 against the bracket 222 draws the cover 216 tightly against the door 76 to securely retain the plug 86 in place. Preferably, a gasket 230 of a sealing material is sandwiched between the plug body 218 and door 76 to airtightly seal the recirculation fan access plug 86 in the opening 220 when the plug 86 is secured to the door 76 to prevent heat loss. Preferably, the plug body 218 is insulated to further prevent heat loss through the plug 86 during operation of the heater 30.

Heater Enclosure Wall Construction

Figure 8:
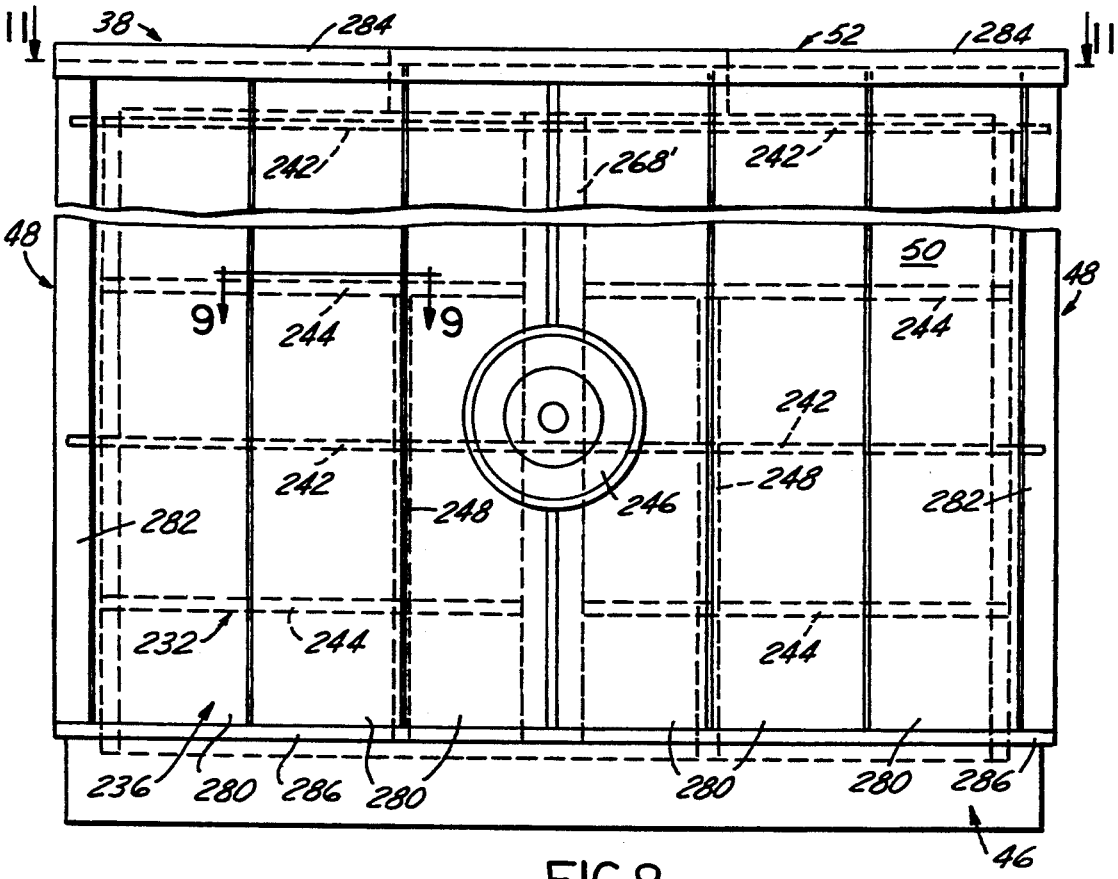
FIG. 8 is a fragmentary end elevational view of the heater enclosure with parts removed showing a wall construction of this invention including supporting framework in phantom.
Figure 9:
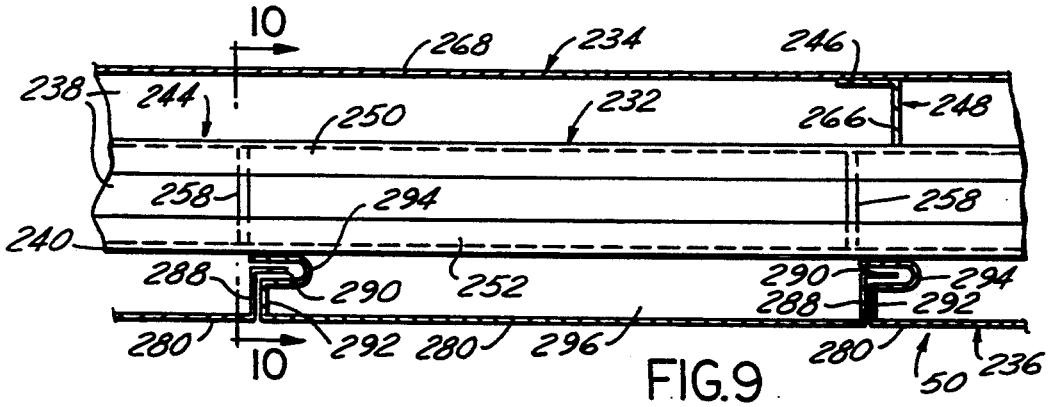
FIG. 9 is an expanded fragmentary longitudinal sectional view of the heater enclosure taken along line 9—9 of FIG. 8 illustrating more clearly the wall construction of the enclosure.
Figure 10:
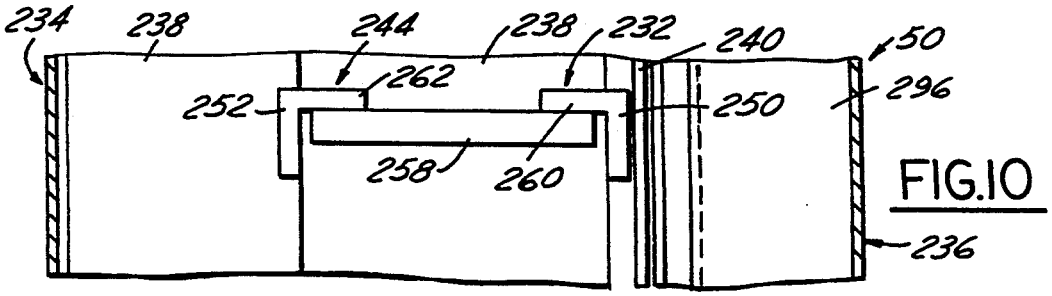
FIG. 10 is an expanded fragmentary transverse sectional view of the heater enclosure taken along line 10—10 of FIG. 9 showing the wall construction of the enclosure.

FIGS. 8–12 illustrate in more detail the construction of the sidewalls 48 and end walls 50 of the enclosure 38. As is more clearly depicted in FIGS. 9 & 10, the sidewalls 48, and end walls 50 are constructed of a frame 232, an inner skin 234 carried by the frame 232, an outer skin 236, and at least one layer of insulation 238 between the inner skin 234 and outer skin 236. Preferably, the outer skin 236 is held in place adjacent the insulation 238 without being secured to or contacting directly the frame 232 or inner skin 234 to produce a wall construction that minimizes the surface area and number of heat conductive paths through each wall 48, 50 of the enclosure 38. As is shown in FIG. 10, preferably, there is a retainer sheet 240 of preferably corrugated construction between the outer skin 236, and the frame 232 and insulation 238 for retaining the insulation 238 against the inner skin 234 and frame 232.

Frame

As is illustrated in phantom in FIG. 8, to support the inner skin 234, the frame 232 has a set of spaced apart horizontal trusses 242 that extend the entire length of each wall. End wall 50 also has a set of horizontal trusses 244 that extend to adjacent the center of the wall 50 and are spaced apart vertically by trusses 242. If desired, depending upon the size of the enclosure 38 more horizontal trusses 242 or trusses 244 may be provided if the inner skin 234 should require more support. To support the inner skin 234 and a circulation fan shaft dish 246 mounted in one end wall 50, the frame 232 of the end wall 50 has a vertical angle iron 248 on either side of the dish 246 secured to the horizontal trusses 242, 244 and the inner skin 234.

Preferably, as is shown in FIGS. 9 & 10, each horizontal truss 242, 244 includes a pair of spaced apart inner 250 and outer 252 stringers or elongate beams that are preferably constructed of generally L-shaped angle iron to produce a truss that is strong, rigid and yet relatively lightweight. At the corners where walls 48 & 50 meet (FIG. 11), the ends of adjacent inner truss stringers 250 of adjacent walls 48, 50 are spaced apart to provide an expansion gap 254 between them for allowing the inner stringers 250 to expand lengthwise without being constrained as the temperature increases during heater operation. Likewise, the ends of adjacent outer truss stringers 252 of adjacent enclosure walls 48, 50 are also spaced apart to provide a thermal expansion gap 256 between them. Preferably, both the inner and outer stringers 250, 252 of each truss 242, 244 are constructed of black iron for producing a truss having a relatively low coefficient of thermal conductivity for minimizing heat transfer through each wall 48, 50 of the enclosure 38.

Figure 11:
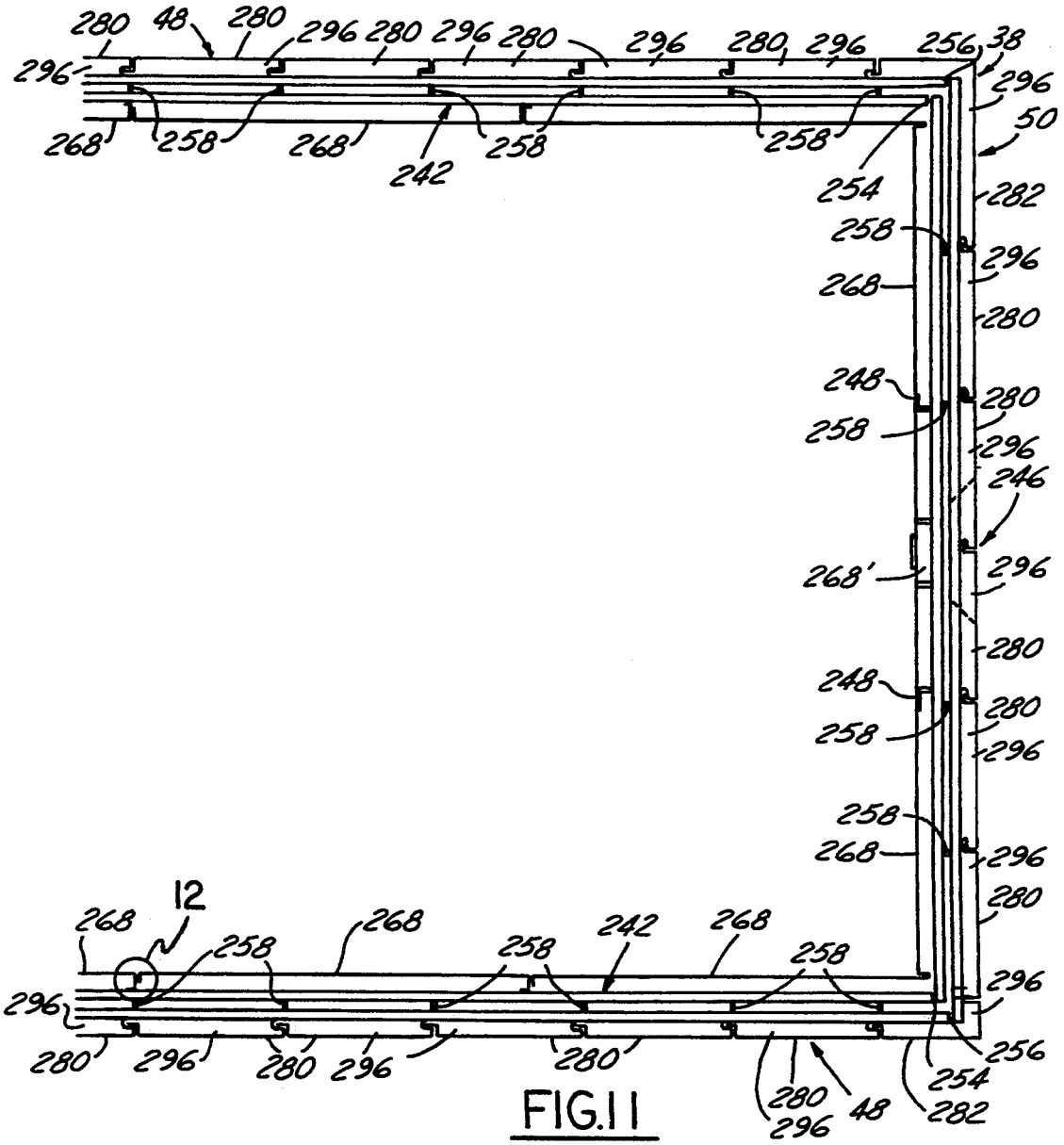
FIG. 11 is a fragmentary sectional plan view of the heater enclosure taken along line 11—11 of FIG. 8.

As is shown in FIGS. 9–11, each pair of inner and outer truss stringers 250, 252 is held apart preferably by a plurality of hollow tubes 258 that are spaced along each horizontal truss 242, 244 to produce a truss that has a minimum of heat conductive paths between each pair of stringers. Referring more particularly to FIG. 10, preferably each spacer tube 258 is secured, such as by welding, adjacent one end to the underside of a leg 260 of the inner stringer 250 and adjacent the opposite end to a leg 262 of the outer stringer 252. Preferably, the spacer tubes 258 are generally uniformly spaced apart along each pair of stringers 250, 252 as is more clearly shown in FIGS. 9 & 11. Preferably, each spacer tube 258 is hollow and constructed of a material, such as black iron, possessing a low thermal conductivity to minimize heat transfer between the inner and outer stringers 250, 252 of each truss 242, 244.

As a result of the fan shaft dish 246 construction of end wall 50, the inner skin 234 is additionally supported by the vertical angle irons 248, as is depicted in FIGS. 8, 9 & 11. The angle irons 248 extend on either side of the fan shaft dish 246 from the bottom of the wall 50 up to truss 242 (FIG. 8). Preferably, each angle iron 248 is generally L-shaped with a leg 264 secured to the inner skin 234 of the end wall 50 and another leg 266 joined to the inner truss stringers 250 of the wall 50 (FIG. 9). Preferably, each angle iron 248 is constructed of black iron for minimizing heat transfer from the inner skin 234 to the inner stringers 250 of end wall 50.

Inner Skin

Referring more particularly to FIG. 11, the inner skin 234 has a plurality of vertically extending skin panels 268 arranged side-by-side within the enclosure 38 forming the inner periphery of the enclosure 38. The inner skin 234 along each end wall 50 also has a centrally located spacer skin panel 268' of relatively narrow construction that lies between a pair of skin panels 268.

Figure 12:
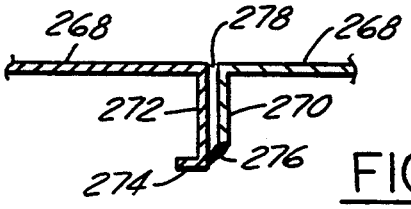
FIG. 12 is a fragmentary view on an enlarged scale of that portion of FIG. 11 of the heater enclosure enclosed by the circle 12.

As is illustrated in more detail in FIG. 12, each inner skin panel 268 preferably has at least one generally perpendicular and vertically extending flange 270 along one side edge of the panel 268 for spacing the panel 242 away from the frame 232 for receiving insulation 238 therein. Preferably, each panel 268 also has an insulation spacer flange 272 along the opposite side edge of the panel 268. Preferably, each insulation spacer flange 272 of each panel 268 also has an inturned leg 274 to enable the skin panels 268 to be supported on the frame 232 of the enclosure 38.

To provide an enclosure 38 having an inner skin 234 of airtight construction, the inner skin panels 268, 268' are sealingly secured along their side edges to the side edge of adjacent inner skin panels. As is more clearly shown in FIG. 12, adjacent panels are joined together preferably by a continuous weld 276 joining the flange 270 of one inner skin panel to the flange 272 of an adjacent panel. Preferably, the weld 276 also spaces the flanges 270, 272 of the adjacent panels apart to form a thermal expansion gap 278 between the panels for accommodating expansion and contraction of the inner skin 234 during operation of the heater 30.

Preferably, each inner skin panel 268, 268' is constructed of sheet steel, such as 14 gauge sheet steel, to produce an inner skin 234 that is lightweight, durable and strong. Preferably, each skin panel is constructed of aluminized sheet steel for providing an inner skin 234 that is highly corrosion and heat resistant to withstand the extreme heat within the enclosure 38.

Outer Skin

As is shown in FIG. 8, the outer skin 236 consists of a plurality of interlocking panels 280 that extend across the length of each wall 48, 50 to cover the entire exterior of each wall 48, 50. At each corner where adjoining walls 48, 50 meet, the outer skin 236 includes a right angled corner panel 282 that is joined to the outer skin panel 280 of each wall 48, 50 that is immediately adjacent the corner panel 282. The outer skin 236 is held in place adjacent the retainer sheet 240 by a strip of flashing 284 extending the length of each wall 48, 50 along its top periphery and is secured along the bottom of each wall 48, 50 by a strip of flashing 286. Preferably, to ease assembly and hold the outer skin panels 280, 282 in place when assembled, the bottom of each outer skin panel 280, 282 is received in a channel (not shown) in the base wall 46.

To facilitate assembly, each outer skin panel 280 is of generally rectangular sheet construction having a right-angled flange 288 with an outwardly extending tongue 290 along one side edge and a flange 292 with a generally U-shaped grooved portion 294 along the other side edge for receiving the tongue 290 of an adjacent outer skin panel 280 to interlock the skin panels together. As is more clearly depicted in FIG. 9, when assembled, the width and tongue-and-groove construction of each outer skin panel 280 provides a relatively loose, but secure, fit between interlocked panels 280 to permit the outer skin 236 to thermally expand and contract without buckling the panels 280, 282 or damaging the enclosure 38. When assembled, only the grooved portions 294 of each panel 280 may abut against the retainer sheet 240 for minimizing the number of heat conductive paths to the exterior of the outer skin 236 to reduce the temperature of the outer skin 236. Preferably, the flanges 288, 292 of each outer skin panel 280 space each panel 280 away from the retainer sheet 240 to provide an insulating air envelope or gap 296 between the sheet 240 and panel 280 for maintaining a safe, burn-preventing outer skin panel temperature. Preferably, each outer skin corner panel 282 is of generally L-shaped construction and is preferably weldably joined along its side edges to adjacent skin panels 280 of adjacent walls 48, 50.

Preferably, each outer skin panel 280, 282 is constructed of sheet steel, such as 18 gauge sheet steel, to provide a skin panel that is relatively lightweight, durable and strong. Preferably, each panel 280, 282 is constructed of galvanized sheet steel for producing an economical, longlasting, highly corrosion resistant outer skin 236.

Insulation

The insulation 238 consists of at least one and preferably two or more layers (not shown) of insulating material that is packed against the inner skin 234 and in and around each pair of frame truss stringers 250, 252. Preferably, each sheet of insulation 238 is constructed of a material that has a relatively high R-value for reducing through-wall heat transmission and is durable for withstanding the extreme environment during the operating life of the heater 30 without degradation or failure. Preferably, the insulation 238 within each wall is constructed of three layers (not shown) of mineral wool board insulation having a density of about 6 lbs./ft$^3$.

Operation

In operation of the heater 30, as indicated by the arrows illustrated in FIG. 4, the circulation fan 32 draws air to be heated from the return tap ductwork and into the enclosure 38 through the return taps 54. As the air enters the enclosure 38, the damper of the makeup air inlet 58 (FIGS. 1 & 2) may be controllably opened to replace air leaked during its passage through the ductwork or lost while in use drying, curing or heating or to admit fresh air to dilute volatile gases in the air stream. After the air enters the enclosure 38, it flows between the tubes 138 on the shell side of the heat exchanger module 36 where it is heated by the hot gases flowing inside the tubes 138. To remove dirt, dust and other particulate matter entrained in the air flowing through the enclosure 38 after it has been heated, the air passes through the filters 126 of the filter bank 34. After being filtered, the air enters the circulation fan impeller 94 through the inlet cone 98 where it is propelled out of the enclosure 38 through the supply taps 56 where the clean, heated air is used for drying, curing or heating.

In operation of the heat exchanger module 36 and burner 40, a gaseous mixture of air and combustion byproducts within the heat exchanger module 36 is propelled by the recirculation fans 42, 44 into the burner sleeve 146 and the annular channel 182 between the sleeve 146 and burner tube 144 where it is heated. As is indicated by the arrows in FIG. 5, gas passing through the sleeve 146 is directly heated by the flame of the burner 40 before exiting into the chamber 150 of rear header 134. Gas flowing through the channel 182 is indirectly heated by the burner 40 and receives heat from the burner sleeve 146 before exiting the burner tube 144 thereby cooling the sleeve 146 and extending its operating life. Simultaneously while the burner 40 is heating the gas within the heat exchanger 36, radiant heat energy from the burner flame and burner sleeve 146, as well as heat from the hot gas within the burner tube 144, is transferred to the heater air within the enclosure passing immediately adjacent to and over the exterior surface of the burner tube 144.

Referring still to FIG. 5, after the heated gas exits the ends of the burner tube 144 and sleeve 146, the flow separator 162 in the rear header chamber 150 splits the gas flow into two streams and the canted panels 166, 168 of header end wall 156 direct each branch of hot gas into the heat exchanger tubes 138 of the upper and lower tube cluster 140, 142. While flowing through each tube 138, the heated gas transfers heat through each tube 138 to the heater air flowing over the exterior surface of each tube 138 warming the heater air. Preferably the turbulators (not shown) in each tube 138 coupled with the increased flow rate of the gases propelled through the tubes 138 by the recirculation fans 42, 44 provide turbulent flow within each tube 138 for maximizing heat transfer through each tube 138 to the heater air.

After exiting the tubes 138, the gas is drawn into the recirculation fan impellers 202 through the inlet cones 212. The gas entering the impellers 202 is again propelled from the fans 42, 44 into the burner tube 144 and sleeve 146 creating a recirculating flow of hot gas within the heat exchanger 36 for significantly reducing the amount of heat that would ordinarily be released out the flue gas tap 66 thereby further increasing the efficiency of the module 36. To maintain a sufficient amount of oxygen within the heat exchanger module 36 to support efficient burner combustion within the burner sleeve 146, a portion of the gas is exhausted out the flue gas tap 66 and fresh air from the burner makeup air tap 70 is injected directly into the burner sleeve 146.

What is claimed is:

1. A heater for indirectly heating a stream of fluid with a burner comprising: a heat exchanger having a bundle of a plurality of tubes for transferring heat from gases heated by a burner and passing through the interior of said tubes to a stream of fluid passing around the exterior of said tubes, a first header communicating with the interior of said tubes of said bundle adjacent one end thereof, a second header communicating with the interior of said tubes of said bundle adjacent the other end thereof, an imperforate burner tube extending through said first header and said bundle of tubes and communicating with said second header, said burner tube having a first end opening exteriorly of said first header and a second end opening into said second header, an imperfoate burner sleeve telescopically received in said burner tube and having a first end opening exteriorly of said first header and associated with the burner to receive the open flame and products of combustion of the burner in said sleeve, and a second open end of said sleeve communicating with said second header to discharge hot gases heated by the burner, said burner sleeve having a smaller outside diameter than the inside diameter of said burner tube so that they define an annular space between them, and a recirculation fan operably associated with said heat exchanger to recirculate the heated gases through said burner sleeve, said annular space between said burner sleeve and burner tube and the interior of said tubes of said bundle of said heat exchanger.

2. The heater of claim 1 wherein said burner sleeve is removable for easy replacement.

3. The heater of claim 1 wherein said burner sleeve is constructed of a stainless steel or another material possessing resistance to high temperature, flame radiation and corrosion.

4. The heater of claim 1 wherein said burner sleeve is constructed of RA 330 stainless steel.

5. The heater of claim 1 wherein said recirculation fan circulates heated gases at a sufficiently high rate of flow to induce or increase turbulence in the heated gases flowing through the interior of said tubes of said heat exchanger to increase heat transfer to said tubes of said heat exchanger, whereby the operating temperature within said heat exchanger is reduced to increase the operating life of said heat exchanger.

6. The heater of claim 1 wherein said heat exchanger comprises a gas-to-gas cross flow heat exchanger for transferring heat from heated gases with said heat exchanger to air flowing around the exterior of said tubes of said heat exchanger.

7. The heater of claim 1 which also comprises a natural gas burner for heating the gases recirculated within said heat exchanger.

8. The heater of claim 1 wherein said recirculation fan recirculates heated gas within said heat exchanger at a sufficiently high rate of flow to induce or increase turbulence in the heated gas flowing within said tubes of said heat exchanger and said burner tube for increasing heat transfer from the gas within said heat exchanger.

9. The heater of claim 1 wherein said heat exchanger also comprises a flow separator received in said second header for redirecting heated gases leaving said burner tube and burner sleeve into said tubes of said heat exchanger.

10. The heater of claim 1 wherein the fluid flowing around the exterior of said tubes of said heat exchanger is air and flows generally perpendicular to the axes of said tubes of said heat exchanger in a cross flow arrangement.

11. The heater of claim 1 wherein said heat exchanger tubes are spaced apart from each other in a staggered array.

12. The heater of claim 1 wherein said headers, tubes of said heat exchanger and burner tube are constructed of stainless steel.

13. The heater of claim 1 which also comprises a filter for removing particulate matter entrained in the fluid flowing around the exterior of said tubes of said heat exchanger.

14. The heater of claim 1 which also comprises an enclosure in which said heat exchanger is received, said enclosure having a bottom wall, a plurality of upstanding sidewalls, and a top wall and said sidewalls having an inner skin, a frame carrying said inner skin, a layer of insulation adjacent said inner skin for preventing heat transfer through said walls, and an outer skin surrounding said frame without being in contact with said frame or inner skin for minimizing heat transfer through said sidewalls.

15. The heater of claim 14 which also comprises an air gap between said insulating material and said outer skin for preventing heat transfer to said outer skin to maintain a safe outer skin temperature.

16. The heater of claim 14 wherein said frame comprises a plurality of vertically spaced apart horizontal trusses.

17. The heater of claim 16 wherein each said truss comprises a pair of horizontally extending elongate stringers separated laterally from each other by a plurality of longitudinally spaced apart and generally tubular spacers providing sufficient clearance for receiving said insulating material while minimizing the number and surface area of heat conductive paths between each pair of said stringers of each said truss.

18. The heater of claim 14 which also comprises an air gap between said insulating material and said outer skin for preventing heat transfer to said outer skin to maintain a safe outer skin temperature.

19. The heater of claim 18 which also comprises a sheet interjacent said insulating material and said outer skin for retaining said insulating material.

20. The heater of claim 18 wherein said frame comprises a plurality of vertically spaced apart horizontal trusses.

21. The heater of claim 20 wherein each said truss comprises a pair of horizontally extending elongate stringers separated laterally from each other by a plurality of longitudinally spaced apart and generally tubular spacers providing sufficient clearance for receiving said insulating material while minimizing the number and surface area of heat conductive paths between each pair of said stringers of each said truss.

22. The heater of claim 18 wherein said inner skin is comprised of a plurality of vertically extending inner skin panels, each said inner skin panel joined to each adjacent said inner skin panel to create a gas-tight seal between adjacent said inner skin panels to prevent convective heat loss from the enclosure.

23. The heater of claim 18 wherein said outer skin is comprised of a plurality of vertically extending outer skin panels having a tongue along one side edge for interlocking with an adjacent said outer skin panel and a groove along the opposite side edge to receive said tongue of an adjacent said outer skin panel for interlocking said outer skin panel with an adjacent said outer skin panel.

24. The heater of claim 23 wherein said tongue and groove construction of said outer skin panels is of a loose fit when assembled and at normal room temperature to provide suitable room for thermal expansion when the temperature of the enclosure is increased.

25. The heater of claim 1 which also comprises a fan which moves a gaseous fluid over the exterior of said tubes of said bundle of said heat exchanger to heat the gaseous fluid to an elevated temperature.

26. The heater of claim 25 wherein said fan moves the gaseous fluid over said tubes of said bundle of said heat exchanger along a path generally perpendicular to the axes of said tubes of said heat exchanger.

27. The heater of claim 25 in which said fan has an impeller, an inlet cone with a necked down portion and said cone is pivotally mounted to move away from said impeller of said fan to facilitate access to said impeller.

28. The heater of claim 14 which also comprises a fan disposed in said enclosure, said fan being constructed and arranged to move a gaseous fluid through said enclosure and over the exterior of said tubes of said bundle of said heat exchanger to heat the gaseous fluid to an elevated temperature.

29. The heater of claim 28 in which said fan has an impeller, an inlet cone with a necked down portion and said cone is pivotally mounted to move away from said impeller of said fan to facilitate access to said impeller.

* * * * *